US005523273A

United States Patent [19]

McQuaide

[11] Patent Number: 5,523,273

[45] Date of Patent: Jun. 4, 1996

[54] PRINTING PROCESS

[75] Inventor: Thomas W. McQuaide, Uniontown, Ohio

[73] Assignee: The University of Akron, Akron, Ohio

[21] Appl. No.: 64,542

[22] Filed: May 19, 1993

[51] Int. Cl.[6] ..... B41M 5/035; B41M 5/38

[52] U.S. Cl. ..... 503/227; 428/34.6; 428/36.5; 428/195; 428/206; 428/207; 428/318.4; 428/913; 428/914

[58] Field of Search ..... 8/471; 428/195, 428/206, 207, 913, 914, 318.4, 34.6, 36.5; 503/227

[56] References Cited

U.S. PATENT DOCUMENTS 4,943,555 7/1990 Nakamoto et al. ..... 503/227
4,971,950 11/1990 Kato et al. ..... 503/227
4,992,414 2/1991 Kishida et al. ..... 503/227
5,001,106 3/1991 Egashira et al. ..... 503/227
5,135,905 8/1992 Egashira et al. ..... 503/227
5,142,722 9/1992 Kolb ..... 8/471

*Primary Examiner*—B. Hamilton Hess
*Attorney, Agent, or Firm*—Hudak & Shunk Co.

[57] ABSTRACT

A process for printing substrates with sublimation dyes comprises coating the substrate with successive polymeric coatings, the first of which include inorganic filler particles contained in a binder polymer that functions as a barrier to the dyes, preventing them from entering the substrate. The second, outer coating, has an affinity for the dyes, facilitating printing on them. The process is particularly useful for printing polymeric foamed and elastomeric substrates.

5 Claims, 1 Drawing Sheet

PRINTING PROCESS

TECHNICAL FIELD

This invention relates to processes for printing on polymeric substrates. More particularly, this invention relates to processes for printing on polymeric substrates having a cellular or elastomeric structure. Specifically, this invention relates to processes for coating foamed or elastomeric material with pigmented polymeric barrier coatings; thereafter coating them with polymeric dye receptive coatings, and subsequently printing the coated materials with sublimation dyes.

BACKGROUND OF THE INVENTION

It has always been desirable to print manufactured articles with designs, advertising copy, slogans, owner affiliations, and the like. In the case of articles difficult to print, printing has often been accomplished through the use of silk screening techniques, which entail forcing thickened inks through a patterned screen in contact with the surface to be printed. While the silk screen process commonly involves the use of mechanical or power-operated presses, it may also be performed manually as well, and in fact, manual printing is sometimes the only practical method for silk screening articles possessing three-dimensional surfaces.

While the silk screen process is simple in concept, it is not without certain inherent drawbacks. For example, while single-color printing is relatively easy to accomplish, that involving multi-color reproduction requires the use of successive screens, each being confined to the application of a single color. Since the multiple colors are normally associated in an integral design, accuracy of placement of the design components on the articles being printed, i.e., the color register, is quite important. Such placement is frequently difficult to achieve, however, particularly on articles with three-dimensional surfaces. Furthermore, the process is time-consuming when performed manually, and it requires a relatively high degree of skill on the part of the practitioner.

In recent years, sublimation printing techniques have increasingly been employed in the printing of articles that are difficult to print. The sublimation process involves the printing of a desired design on a paper backing sheet by conventional printing techniques employing sublimation inks for the purpose, and then transferring the designs under heat and pressure from the backing sheet to the article being printed. Although somewhat dull and off-colored when printed on the backing sheet, sublimation inks have been found to possess the ability to produce brilliant colors and clear designs on the articles being printed; consequently, the process is now frequently employed.

Despite such notable advantages, however, sublimation printing is relatively unsatisfactory for printing certain types of articles. In the case of those fabricated from foamed materials, for instance, sublimation dyes have an unfortunate tendency to penetrate into the cellular structure of the articles, from which location the colors migrate beyond the area intended for printing. In the case of single-color printing, ink migration results in fuzzy definition and causes unintended color dilution. In the case of multi-colored printing, undesirable mixing of colors also results. The phenomenon described is particularly evident with the passage of time.

Similarly, in the case of elastomers, such materials are commonly compounded to include various extending oils, processing aids and the like, all of which tend to act as a solvent for sublimation dyes. When the dyes are imprinted on the surface of these materials, therefore, they tend to become solvated, and in that condition to disperse into unintended areas with the disadvantages previously described.

In the case of beverage insulators, for example, i.e. polymeric foamed sleeves designed to fit over beverage holders such as drinking glasses for the purpose of maintaining the contents thereof thermally constant, it is often desirable to imprint the outer surface of the insulators with the names of the owner, sport teams, logos, and the like. If such imprinting is not visually crisp and sharply defined, however, it greatly detracts from the appearance of the imprinted insulators, and consequently, adversely affects their marketability.

In view of the preceding, therefore, it is a first aspect of this invention to provide an improved process for imprinting foamed and elastomeric articles.

A second aspect of this invention is to provide a process for transferring imprinting with good definition onto the surfaces of articles, particularly those having cellular or elastomeric structures.

Another aspect of this invention is to provide an improved method for imprinting cellular or elastomeric articles with sublimation dyes.

An additional aspect of this invention is to provide a system for preventing the penetration of sublimation dyes into the interior of cellular or elastomeric substrates.

A further aspect of this invention is to provide a system for coating the surfaces of cellular or elastomeric articles with a barrier structure that prevents the passage of sublimation dyes therethrough.

Yet an additional aspect of this invention is to provide two-component barrier structures that enhance the printing of substrates.

A still further aspect of this invention is to provide a two-step process for coating cellular and elastomeric articles in order to facilitate their printing while avoiding the penetration of sublimation dyes into the interior thereof.

BRIEF SUMMARY OF THE INVENTION

The preceding and other aspects of the invention are provided by a process for preparing a substrate to receive a dye comprising applying successive polymeric coatings thereto. The first coating comprises inorganic filler particles mixed in a binder polymer, the filler particles being present in an amount sufficient to provide a substantially continuous barrier between the opposite surfaces of the coating, thereby preventing penetration of the dyes through the coating. After application of the first coating, a second coating having an affinity for the dyes is applied over the first coating.

The preceding and still other aspects of the invention are provided by a process for printing a foamed polymeric substrate with a sublimation dye comprising applying successive polymeric coatings to the substrate. The first coating comprises inorganic filler materials mixed with a binder polymer. On a weight basis, the inorganic filler is present in the binder polymer in the ratio of about 1:1 to about 10:1, filler to binder polymer. A second coating comprising a polymer having an affinity for the dye is subsequently applied and thereafter imprinted with the dye.

The proceding and additional aspects of the invention are provided by foamed beverage insulators and seat cushions imprinted by a process according to the preceding paragraph.

The preceding and other aspects of the invention are provided by a multiply coated substrate, the first coating comprising inorganic filler particles mixed with a binder polymer. The filler particles are present in an amount providing a substantially continuous barrier of filler particles between opposite surfaces of the coating. The barrier substantially prevents dye penetration through the coating into the interior of the substrate. A second coating comprising a polymer having an infinity for the dye is subsequently applied to the first coating.

DETAILED DESCRIPTION OF THE INVENTION

As indicated in the preceding, certain types of substrates, notably foam structures and elastomeric materials are difficult to imprint with sublimation inks. In the case of foams, for example, articles are typically extruded with a smooth outer skin, containing on their interior either open or closed cells, formed, for example, by receiving the extruded material in a bath, where it is cured and blown, for instance, by nitrogen in the case of closed cells, or carbon dioxide, where open cells are desired. Sublimation dyes have a tendency to penetrate the outer skin of the foamed structures and to enter the interior cellular structure where the dyes migrate, producing indistinct printing. In the case of elastomers, on the other hand, the compounding ingredients mix with the dyes, resulting in their migration within the structure, again producing indistinct color patterns.

The process of the invention is designed to overcome the undesirable migration described by first coating the substrate with a thin barrier coating comprising a polymeric binder containing inorganic fillers which are present in an amount sufficient form a barrier that prevents dyes from passing therethrough and entering into the substrate.

While the coating described effectively prevents objectionable dye penetrations, it often resists imprinting on its exposed surface, due to the presence of the filler particles. In consequence of this fact, therefore, it has been found desirable to provide a second coating over the barrier coating of a type capable of forming a bond with the dyes.

Since the sublimation dyes are activated by being heated to relatively high temperatures, it is necessary that the polymers making up the first, i.e., the barrier coating, as well as the second dye receptive coating, be able to withstand the dye activation temperatures.

While not wishing to be bound the theory, it is believed that the functioning of the dye receptive coating is enhanced by the use of polymers having sequential segments, e.g., polar/non-polar/polar repeating segments. The non-polar moieties exhibit dye receptive characteristics, while the polar portions appear to assist in blocking dye migration.

Figure 1:
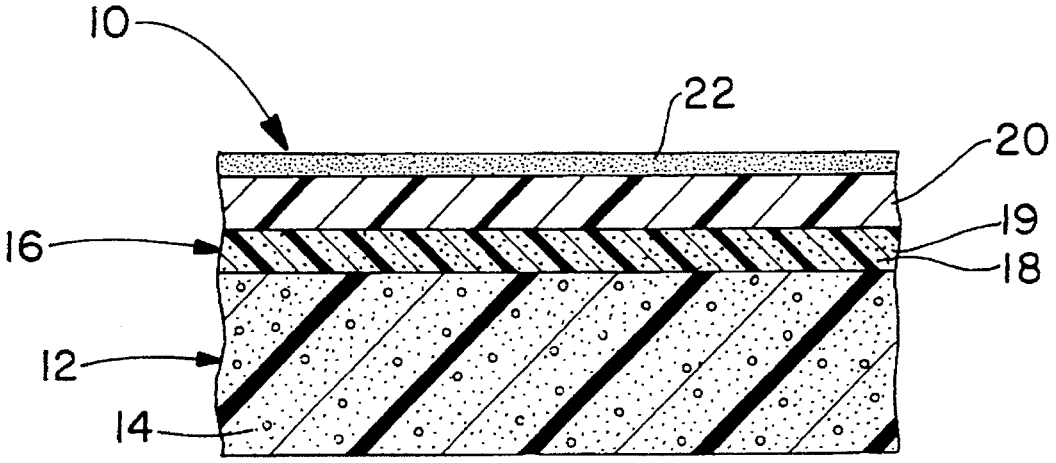
FIG. 1 is a cross-sectional view of a foamed substrate material that has been coated according to the process of the invention and then imprinted with a sublimation dye.

FIG. 1 is a cross-sectional view of a foamed substrate material that has been coated according to the process of the invention and then imprinted with the sublimation dye. As illustrated, the imprinted substrate 10 comprises a foamed structure 14 containing a cellular network. The cellular substrate has been provided with a first coating or barrier film 16, which includes filler particles 18 contained in a binder polymer 19. A dye-receptive coating 20 is provided on top of the barrier film 16 prior to applying a sublimation dye, shown as dye layer 22 in the Figure.

Any of a variety of polymers may be employed to serve as a polymer binder providing they have heat resistive characteristics sufficient to withstand the thermally induced dye activation step. Thermosetting polymers are particularly desired, however, for instance, polyurethanes, epoxy polymers, polyesters, and the like. Epoxy compounds and polyurethane compounds are especially preferred since they can be cured at room temperature, facilitating the coating procedure. Once such epoxy polymer, for example, is Epon 828, a glycidyl ether/bisphenol A material manufactured by Shell.

The binder polymers described are combined with any of various inorganic fillers such as clay, silicon dioxide, titanium dioxide, talc, and the like. As indicated, the inorganic fillers serve as obstacles to dye penetration since they form a particle barrier between opposite surfaces of the barrier film.

The barrier film may include as a binder polymer a polymer displaying either flexible characteristics, or it may be relatively stiff and inflexible. In any event, the film is often inflexible, either as a result of the nature of the polymer, or due to its high filler loading, and unless it is disposed over the surface of the substrate in relatively thin films, it has a tendency to crack, allowing undesirable penetration of dyes. In view of this fact, it has been found desirable to coat the substrate with a barrier film having a thickness of, for example, of up to about 2 mils, more preferably about 1 mil, although thicker films may sometimes be applied.

The amount of filler used in preparing the barrier film 16 is important since it is the barrier action produced by the proximity of the particles with each other that prevents dye penetration. In this regard, the fillers are used in greater amounts than fillers typically found in ordinary filled polymers, for example, it has been determined desirable to provide levels of filler which on a weight basis constitute from about. 10:1 to about 1:1, more desirably from about 2:1 to about 4:1, of filler to binder polymer. When the fillers are present in such amounts, they provide a substantially continuous barrier as may be observed schematically in FIG. 2.

Figure 2:
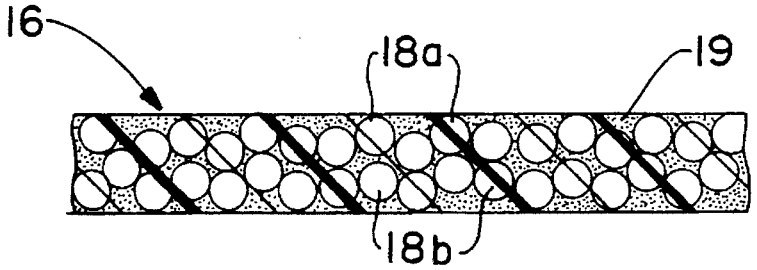
FIG. 2 is a cross-sectional view of the first polymeric coating applied to a substrate to be imprinted according to the process of the invention schematically illustrating the barrier formed by the filler particles contained therein.

FIG. 2 is a cross-sectional view of the first polymeric coating applied to a substrate to be printed according to the process of the invention, schematically illustrating the barrier formed by the filler particles contained therein. The Figure shows a barrier film 16 that includes a particle binding polymer 19 in which are disposed layers of filler particles 18*a* and 18*b*. In the Figure, the particles are schematically shown as being arranged in overlapping layers to emphasize the fact that their presence in the amounts set forth in the proceding substantially eliminates unobstructed pathways from the top of the film to its bottom, through which dye penetration would be possible.

While the size of the particles is relatively unimportant, it has been determined that filler particles within the range of about 0.1 to about 15 microns are particularly well suited to the invention.

Application of the coating may be accomplished in any of the ways well known in the art, for example, by dissolving the polymer in a suitable solvent, for instance, acetone, chloroform, other equivalent solvents or mixtures thereof. The inorganic filler particles may thereafter conveniently be added to the solution and the material applied to the substrate by spraying, dipping or by other means well known in the art. Following coating as described, or by an equivalent procedure, the polymer is cured. As previously referred to, curing can be accomplished at room temperature, or alternatively, curing can be accelerated by heating as for instance in a suitable oven. It is sometimes desirable to apply the barrier coating in multiple coats, i.e., successive spraying or dipping steps.

Following application of the barrier film as described, the coated substrate is subjected to a further, second coating with a dye receptive film. Again, since the coated substrate must be exposed to elevated temperatures during activation of the sublimation dye, the polymer coating must be relatively heat resistant. It has been found desirable, therefore, to use thermosetting polymers, for example, polyurethanes, polyesters, epoxy polymers, and others, although thermoplastic polymers able to resist elevated temperatures such as vinyl alcohol/ethylene polymers may also be employed. Repeating what has already been stated, a second, dye-receptive layer is employed as a second coating in consequence of the fact that direct imprinting of the highly-loaded binder polymer would result in inferior printing.

In addition to being heat resistant, it has also been determined that the second dye-receptive coating should be flexible. In this regard, as previously been indicated, it is desirable that the first or dye barrier coating be relatively thin; consequently, it can be stiff and unyielding without detrimentally affecting performance of the article. However, since the dye-receptive second coating is relatively thick, it is necessary that it be flexible to facilitate grasping and to withstand physical abuse. Where epoxy polymers are used, for example, it has been found desirable to employ those of the relatively flexible polyglycol type as, for example, Scotch-weld 2216B/A marketed by the 3M Company.

With respect to flexibility, it has been determined that polymer hardness provides an indirect measure of flexibility, and in this connection, it has been found that dye-receptive coatings possessing a Shore D hardness according to ASTM test D2240 of from about 30 to about 70 provide superior results. Referring again to the thickness of the second or dye-receptive coating, coatings up to about 20 mils are readily imprinted with sublimation dyes and are able to successfully function in the physical environment to which they are exposed during use of the printed article.

Application of the dye-receptive coating and its subsequent cure are essentially equivalent to the techniques described in the foregoing in relation to the dye-barrier coating.

Following application of both the dye-barrier coating and the dye-receptive coating, a backing sheet containing sublimation dyes in the desired colors and arrangement is placed in contact with the coated substrate under pressure, and the dyes contained thereon activated by heating, commonly in the range of 350° F. to about 450° F. The sublimation dyes thereupon sublimate and transfer to the dye receptive coating, producing the desired imprinted article.

Example

By way of illustration, printing according to the procedure described is carried out by imprinting a cellular, foamed beverage cooler in the following manner.

Epon 828 from Shell Chemical Co., 32 parts by weight, is combined with titanium dioxide, i.e., Ti Pure marketed by the Dupont Co., 98 parts by weight. The inorganic fillers described are added to a mixture of acetone, 400 milliliters, and chloroform, 200 milliliters.

The mixture is stirred with a magnetic stir bar and the foam substrate dipped therein before being dried in a 100° C. oven for 10 minutes. Redipping is repeatedly carried out until five coats of the barrier film have been applied.

Thereafter, the dye receptive coat is applied as follows.

Ten parts by weight of Scotch-weld 2216 B/A two-epoxy is mixed with 200 milliliters of chloroform to provide a dipping solution. The previously coated substrate is dipped and cured as described in connection with the barrier coating until five coats of the dye-receptive material have been applied. The resulting substrate is thereafter cured for an additional 40 minutes at 70° C. until it became tac-free.

Following coating as described, the coated substrate is printed with a sublimation dye at a temperature of 360° F., yielding a sharp, clear imprint on the substrate with no signs of migration.

While other uses may be envisioned, substrates including polyurethane foams, PVC foams, foamed polystyrene, rubber foams, and others, in the form of cushions, beverage container insulators, knee pads, foam balls, foamed sporting goods, tires, and other similar and different materials may be successfully imprinted with the sublimation dyes of the type contemplated by the invention.

While in accordance with the patent statutes, a preferred embodiment and best mode has been presented, the scope of the invention is not limited thereto, but rather is measured by the scope of the attached claims.

What is claimed is:

1. A process for printing a foamed polymeric substrate with a sublimation dye comprising:

applying a first coating to said substrate, said coating comprising inorganic filler particles mixed with a binder polymer, said filler particles being present on a weight basis on the ratio of said filler particles to said binder particles of from about 1:1 to about 10:1;

thereafter applying a second coating comprising a polymer having an affinity for said dye and a Shore D hardness of about 30 to about 70, and subsequently imprinting said second coating with said dye, wherein said binder polymer and the polymer in said second coating are thermosetting polymers.

2. A process according to claim 1, in which said binder polymer and the polymer in said second coating are members selected from the group consisting of a polyurethane polymer, and epoxy polymer, and a polyester polymer.

3. A process according to claim 1, in which said inorganic filler particles are talc particles.

4. Foamed beverage insulators and foamed seat cushions printed by a process for printing a foamed polymeric substrate with a sublimation dye comprising:

applying a first coating to said substrate, said coating comprising inorganic filler particles mixed with a binder polymer, said filler particles being present on a weight basis in the ratio of said filler particles to said binder particles of from about 1:1 to about 10:1;

thereafter applying a second coating comprising a polymer having an affinity for said dye, and subsequently imprinting said second coating with said dye.

5. A substrate coated with a first coating comprising inorganic filler particles mixed with a binder polymer, said filler particles being present in an amount providing a substantially continuous barrier of filler particles between opposite surfaces of said coating, said barrier substantially preventing dye penetration through said coating into said substrate, said substrate being coated with second coating on said first coating, said second coating comprising a polymer having an affinity for said dye, in which on a weight basis, the ratio of said filler particles to said binder polymer is from about 1:1 to about 10:1, wherein said substrate is a polymeric foam.

* * * * *